US007224354B2

(12) United States Patent
Ko et al.

(10) Patent No.: US 7,224,354 B2
(45) Date of Patent: May 29, 2007

(54) APPARATUS AND METHOD FOR GENERATING HIGH-VOLTAGE REGULATION SIGNAL IN A DISPLAY

(75) Inventors: Sung-cheol Ko, Gyeonggi-do (KR); Hyun-suk Kim, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 535 days.

(21) Appl. No.: 10/732,246

(22) Filed: Dec. 11, 2003

(65) Prior Publication Data

US 2004/0119707 A1 Jun. 24, 2004

(30) Foreign Application Priority Data

Dec. 11, 2002 (KR) ..... 10-2002-0078717

(51) Int. Cl.
*G09G 5/00* (2006.01)

(52) U.S. Cl. ..... 345/211; 345/212

(58) Field of Classification Search ..... 327/530, 327/538, 540; 310/68; 345/50, 52, 53, 904, 345/211, 212, 213, 214; 363/16, 56.12, 89, 363/95, 80; 375/238, 239, 242, 285
See application file for complete search history.

(56) References Cited

U.S. PATENT DOCUMENTS 4,808,906 A * 2/1989 Liepe ..... 323/223
5,517,064 A * 5/1996 Murakami ..... 307/10.1
6,114,899 A * 9/2000 Jang et al. ..... 327/540
2002/0089370 A1* 7/2002 Shin ..... 327/536
2003/0075997 A1* 4/2003 Keim et al. ..... 310/68 D

FOREIGN PATENT DOCUMENTS

KR 1020010073251 8/2001

OTHER PUBLICATIONS

Chinese Patent Office Action for corresponding Chinese Patent Application No. 2003101254628 dated Jun. 9, 2006.

* cited by examiner

*Primary Examiner*—Nitin Patel
(74) *Attorney, Agent, or Firm*—Staas & Halsey LLP

(57) ABSTRACT

An apparatus to genearate a high-voltage regulation signal to control regulation of a display, including: a pulse generator to generate a pulse; a reference signal generator to generate a reference signal with a desired duty ratio using the pulse generated from the pulse generator; and a high-voltage signal generator to generate a switching signal with a duty ratio controlled by the reference signal, according to the pulse from the pulse generator and a feedback regulation output voltage, and to generate a high-voltage regulation signal according to the switching signal, wherein the feedback regulation output voltage is based upon the high-voltage regulation signal.

18 Claims, 2 Drawing Sheets

APPARATUS AND METHOD FOR GENERATING HIGH-VOLTAGE REGULATION SIGNAL IN A DISPLAY

CROSS-REFERENCE TO RELATED APPLICATIONS

This application claims the priority of Korean Patent Application No. 2002-78717, filed on Dec. 11, 2002, in the Korean Intellectual Property Office, the disclosure of which is incorporated herein in its entirety by reference.

BACKGROUND OF THE INVENTION

1. Field of the Invention

The present invention relates to a regulation circuit for a Color Display Tube (CDT), and, more particularly, to an apparatus and method for generating a high-voltage regulation signal capable of protecting components in a regulation circuit.

2. Description of the Related Art

Images on a bright area of a display screen sometimes appear as being expanded, and images on a dark area of the display screen sometimes appear as being contracted. This situation occurs because of a poor high-voltage regulation. Generally, image displays include a regulation circuit for controlling such a high-voltage regulation which has a direct influence on picture quality.

FIG. 1 is a block diagram of a regulation circuit used in a conventional Color Display Tube (CDT). The regulation circuit comprises an oscillation circuit 100, a Pulse Width Modulation (PWM) generator 110, a switching unit 120, a transformer 130, an error detector 140, and a feedback unit 150.

The oscillation circuit 100 generates an oscillation clock pulse. The PWM generator 110 generates and outputs a PWM control signal for controlling a high-voltage regulation using the oscillation clock pulse. The switching unit 120 outputs a signal switched according to the PWM control signal output from the PWM generator 110.

The transformer 130 generates and outputs a high-voltage regulation signal at a secondary side, using an output signal from the switching unit 120 as a primary-side voltage. The transformer 130 supplies the high-voltage regulation signal via a secondary-side output to the CDT, and simultaneously supplies a feedback voltage, proportional to the high-voltage regulation signal, to the PWM generator 110 via the feedback unit 150.

The error detector 140 detects an error using the signal output from the switching unit 120. When an error is detected, the error detector 140 notifies the PWM generator 110 of the error to enable the PWM generator 110 to stop outputting the PWM signal.

However, in the conventional regulation circuit, an error is detected after an excessive current due to the error already flows to the switching unit 120, and then the voltage signal input to the switching unit 120 is controlled. Therefore, components constituting the switching unit 120 can be damaged due to the excessive current. Such a damage of the switching unit adversely affects the control of the regulation voltage, thereby resulting in deterioration of picture quality of the CDT. Furthermore, the components constituting the switching unit 120 must be frequently replaced, resulting in an increase in cost of the whole system.

SUMMARY OF THE INVENTION

The present invention provides an apparatus and method for generating a high-voltage regulation signal that protects a switching device, in order to stabilize a regulation voltage of a display and achieve a reduction in costs thereof.

Additional aspects and/or advantages of the invention will be set forth in part in the description which follows and, in part, will be obvious from the description, or may be learned by practice of the invention.

According to an aspect of the present invention, there is provided an apparatus to generate a high-voltage regulation signal to control regulation of a display, the apparatus comprising: a pulse generator to generate a pulse; a reference signal generator to generate a reference signal with a desired duty ratio using the pulse generated from the pulse generator; and a high-voltage signal generator to generate a switching signal with a duty ratio controlled by the reference signal, according to the pulse from the pulse generator and a feedback regulation output voltage, and to generate a high-voltage regulation signal according to the switching signal, wherein the feedback regulation output voltage is based upon the the high-voltage regulation signal.

The pulse generator may generate a square wave pulse to synchronize a frequency of a regulation output voltage signal with a horizontal frequency of the display to which a regulation voltage is supplied.

The high-voltage signal generator may comprise: a Pulse-Width Modulation (PWM) generator to generate a PWM control signal according to the pulse from the pulse generator and the feedback regulation output voltage; a switching unit to generate a primary induction voltage switched according to the PWM control signal; a transformer to generate a secondary induction voltage proportional to the primary induction voltage; and a feedback unit to generate the feedback regulation output voltage based upon the secondary induction voltage to the PWM generator.

The reference signal generator may generate the reference signal on the basis of a regulation voltage specification of the display and a maximum current tolerance of the switching unit.

According to another aspect of the present invention, there is provided an apparatus to generate a high-voltage regulation signal to control regulation of a display, the apparatus comprising: a pulse generator to generate a pulse; a PWM generator to generate a PWM signal to control the regulation using the pulse generated from the pulse generator; a switching unit to output a primary induction voltage switched according to the PWM signal; a transformer to output a secondary regulation voltage proportional to the primary induction voltage; and a reference signal generator to generate a reference signal having a desired duty ratio using the pulse from the pulse generator and supply the reference signal to the PWM generator, wherein the PWM generator stops outputting the PWM signal in response to a duty ratio of the PWM signal being above the duty ratio of the reference signal.

The pulse generator may generate a square wave signal to synchronize a frequency of the secondary regulation voltage signal with a horizontal frequency of the display to which the secondary regulation voltage is supplied.

The reference signal may be set in consideration of a regulation voltage specification of the display and a maximum current tolerance of the switching unit.

According to still another aspect of the present invention, there is provided a method of generating a high-voltage regulation signal in a display, the method comprising: setting a reference signal with a desired duty ratio; generating a PWM signal to control regulation of the display; comparing the PWM signal to the reference signal; stopping outputting the PWM signal in response to a duty ratio of the PWM signal being above a duty ratio of the reference signal; and generating a high-voltage signal switched by the PWM signal.

The reference signal may be set in consideration of a regulation voltage specification of the display and a maximum current tolerance of a switching unit that generates the high-voltage signal switched by the PWM signal.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
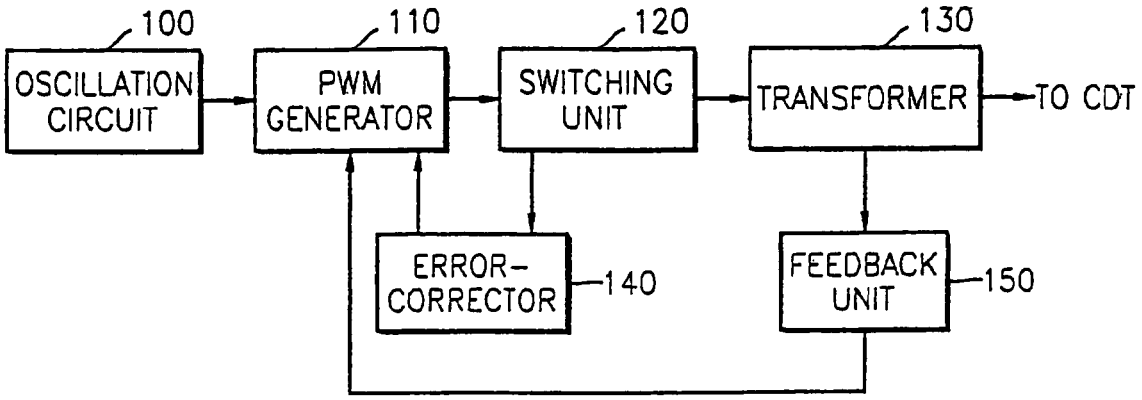
FIG. 1 PRIOR ART
FIG. 1 is a block diagram of a regulation circuit used in a conventional CDT.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
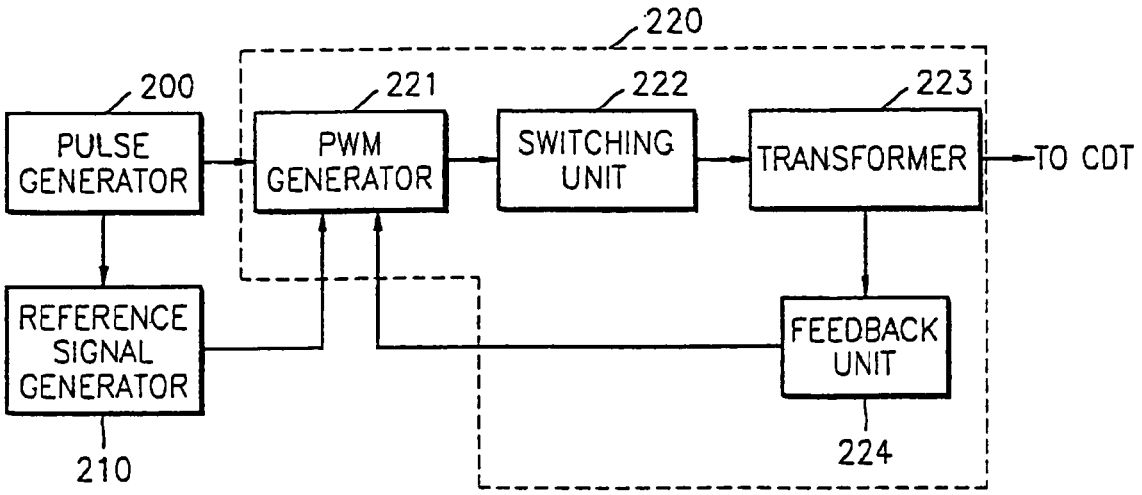
FIG. 2 is a block diagram of an embodiment of an apparatus for generating a high-voltage regulation signal, according to the present invention.

FIG. 2 is a block diagram of an apparatus generating a high-voltage regulation signal, according to an embodiment of the present invention.

The high-voltage regulation signal generation apparatus controlling regulation of a display comprises a pulse generator 200, a reference signal generator 210, and a high-voltage signal generator 220.

The pulse generator 200 generates a square wave pulse to synchronize a frequency of a regulation output voltage signal with a horizontal frequency of a display such as a CDT, to which a regulation voltage is supplied.

The reference signal generator 210 generates a reference signal with a desired duty ratio using a pulse generated from the pulse generator 200. The reference signal has a duty ratio by which a maximum pulse width of the reference signal does not apply a load to a switching device, in consideration of a maximum current tolerance of the switching component included in the high-voltage signal generator 220, while maximally satisfying the regulation voltage specification of the display.

The high-voltage signal generator 220 generates a switching signal with a duty ratio controlled by the reference signal, according to an output pulse from the pulse generator 200 and a feedback regulation output voltage, and generates a high-voltage regulation signal according to the switching signal. The high-voltage signal generator 220 includes a Pulse-Width Modulation (PWM) generator 221 which generates a PWM control signal according to the pulse from the pulse generator 200 and the feedback regulation output voltage, a switching unit 222 which generates a primary induction voltage switched according to the PWM control signal, a transformer 223 which generates a secondary induction voltage having a desired multiplied value in proportion to the primary induction voltage, and a feedback unit 224 which transfers information related to the secondary induction voltage to the PWM generator 221.

The PWM generator 221 compares the duty ratio of the generated PWM signal with the duty ratio of the reference signal generated from the reference signal generator 210, and stops outputting the PWM signal when the duty ratio of the PWM signal is above the duty ratio of the reference signal, thereby preventing an excessive current from flowing to the switching unit 22.

Figure 3:
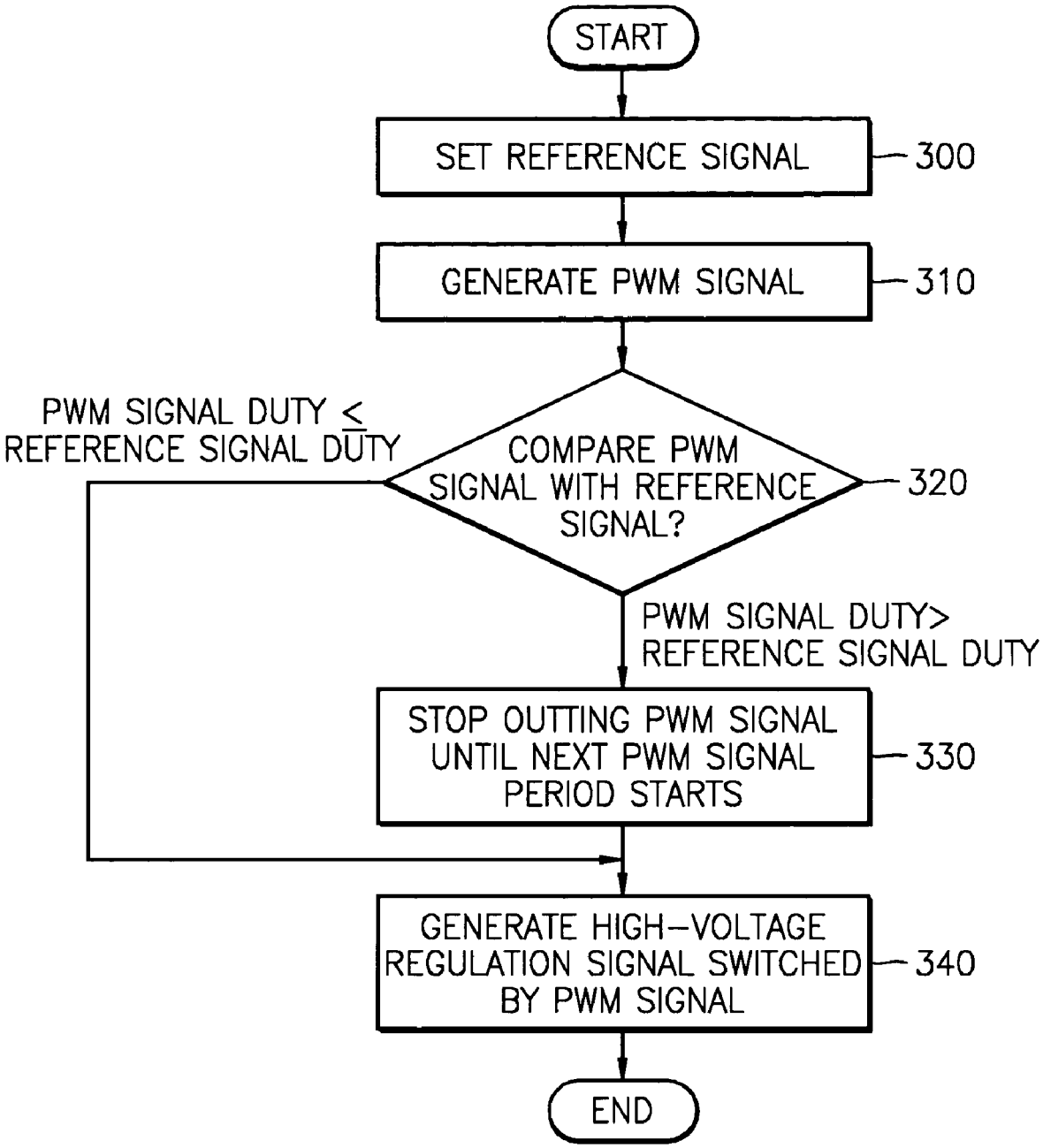
FIG. 3 shows a flow chart illustrating a method of generating a high-voltage regulation voltage, according to an embodiment of the present invention.

FIG. 3 shows a flow chart illustrating a method of generating a high-voltage regulation voltage, according to the present invention.

Referring to FIG. 2, first, a reference signal is set as a pulse signal with a desired duty ratio in operation 300. The reference signal may have a desired duty ratio by which a maximum pulse width of the reference signal does not apply a load to the switching device, in consideration of a maximum current tolerance of the switching component constituting the switching unit 222 of FIG. 2, while maximally satisfying the regulation voltage specification of the display. Such a duty ratio of the reference signal will be determined by the designer of the circuit.

Then, a PWM signal to control regulation of the display is generated in operation 310. The PWM signal is created using a feedback regulation output voltage and a square wave pulse for synchronizing a frequency of a regulation output voltage signal with a horizontal frequency of a display such as a CDT, to which a regulation voltage is supplied.

Thereafter, the PWM signal is compared to the reference signal in operation 320. When the duty ratio of the PWM signal is above the duty ratio of the reference signal, the output of the PWM signal is interrupted in operation 330. The output of PWM signal begins again when the next PWM signal period starts.

Then, a high-voltage signal switched according to the PWM output signal is generated in operation 340. A primary induction voltage switched by the PWM output signal is first generated, and a secondary induction voltage having a desired divided value proportional to the primary induction voltage is generated as a high-voltage regulation voltage. The generated high-voltage regulation voltage is output to the display. Also, high-voltage regulation information related to the high-voltage regulation voltage is sent back to the PWM generator 221, so that it can be provided when a new PWM signal is generated.

As described above, according to the present invention, an apparatus for generating a regulation voltage for a display can prevent a switching component from being damaged, stabilize a regulation voltage, and contribute to a reduction in the costs of the display, by restricting a duty ratio of a regulation control voltage in advance.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An apparatus to generate a high-voltage regulation signal to control regulation of a display, the apparatus comprising:

a pulse generator to generate a pulse;

a reference signal generator to generate a reference signal with a desired duty ratio using the pulse generated from the pulse generator; and a high-voltage signal generator to generate a switching signal with a duty ratio controlled by the reference signal, according to the pulse from the pulse generator and to a feedback regulation output voltage, and to generate a high-voltage regulation signal according to the switching signal, wherein the feedback regulation output voltage is based upon the high-voltage regulation signal.

2. The apparatus of claim 1, wherein the pulse generator generates a square wave pulse to synchronize a frequency of a regulation output voltage signal with a horizontal frequency of the display to which a regulation voltage is supplied.

3. The apparatus of claim 1, wherein the high-voltage signal generator comprises:

a Pulse-Width Modulation (PWM) generator to generate a PWM control signal according to the pulse from the pulse generator and the feedback regulation output voltage;

a switching unit to generate a primary induction voltage switched according to the PWM control signal;

a transformer to generate a secondary induction voltage proportional to the primary induction voltage; and a feedback unit to generate the feedback regulation output voltage based upon the secondary induction voltage to the PWM generator.

4. The apparatus of claim 3, wherein the reference signal generator generates the reference signal on the basis of a regulation voltage specification of the display and a maximum current tolerance of the switching unit.

5. The apparatus of claim 4, wherein the desired duty ratio of the reference signal is set so that a maximum pulse width of the reference signal precludes a load from being applied to the switching unit.

6. The apparatus of claim 3, wherein the PWM generator compares a duty ratio of the PWM control signal with the duty ratio of the reference signal, and stops outputting the PWM control signal in response to the duty ratio of the PWM control signal being above the duty ratio of the reference signal.

7. The apparatus of claim 1, wherein the display is a color display tube (CDT).

8. An apparatus to generate a high-voltage regulation signal to control regulation of a display, the apparatus comprising:

a pulse generator to generate a pulse;

a PWM generator to generate a PWM signal to control the regulation using the pulse generated from the pulse generator;

a switching unit to output a primary induction voltage switched according to the PWM signal;

a transformer to output a secondary regulation voltage proportional to the primary induction voltage; and a reference signal generator to generate a reference signal having a desired duty ratio using the pulse from the pulse generator and supply the reference signal to the PWM generator, wherein the PWM generator stops outputting the PWM signal in response to a duty ratio of the PWM signal being above the duty ratio of the reference signal.

9. The apparatus of claim 8, wherein the pulse generator generates a square wave signal to synchronize a frequency of the secondary regulation voltage signal with a horizontal frequency of the display to which the secondary regulation voltage is supplied.

10. The apparatus of claim 8, wherein the reference signal is set in consideration of a regulation voltage specification of the display and a maximum current tolerance of the switching unit.

11. A high voltage signal generator to generate regulation voltage for a display, comprising:

a Pulse-Width Modulation (PWM) generator to generate a PWM control signal; and a switching unit to generate a voltage switched according to the PWM control signal;

wherein the PWM generator compares a duty ratio of the PWM control signal to a duty ratio of a reference signal, and stops outputting the PWM control signal in response to the duty ratio of the PWM control signal being above the duty ratio of the reference signal.

12. The high voltage signal generator of claim 11, wherein the duty ratio of the reference signal is set so that a maximum pulse width of the reference precludes a load from being applied to the switching unit.

13. A method of generating a high-voltage regulation signal in a display, the method comprising:

setting a reference signal with a desired duty ratio;

generating a PWM signal to control regulation of the display;

comparing the PWM signal to the reference signal;

stopping outputting the PWM signal in response to a duty ratio of the PWM signal being above a duty ratio of the reference signal; and generating a high-voltage signal switched by the PWM signal.

14. The method of claim 13, wherein the reference signal is set in consideration of a regulation voltage specification of the display and a maximum current tolerance of a switching unit that generates the high-voltage signal switched by the PWM signal.

15. The method of claim 13, wherein the reference signal is set as a pulse signal.

16. The methodof claim 13, wherein the PWM signal is generated using a feedback regulation output voltage and a square wave pulse to synchronize a frequency of a regulation output voltage signal with a horizontal frequency of the display, wherein the feedback regulation output voltage is based upon the high-voltage signal switched by the PWM signal.

17. The method of claim 13, wherein the generating a high-voltage signal switched by the PWM signal comprises:

generating a primary induction voltage switched by the PWM signal; and generating a secondary induction voltage proportional to the primary induction voltage;

wherein the secondary induction voltage is output to the display as the high-voltage signal.

18. The method of claim 13, wherein information related to the high-voltage signal is fed back and used in generating a new PWM signal.

* * * * *

UNITED STATES PATENT AND TRADEMARK OFFICE

CERTIFICATE OF CORRECTION

PATENT NO. : 7,224,354 B2
APPLICATION NO. : 10/732246
DATED : May 29, 2007
INVENTOR(S) : Sung-cheol Ko et al.

It is certified that error appears in the above-identified patent and that said Letters Patent is hereby corrected as shown below:

First Page, Column 2 (Abstract), Line 1, change “genearate” to --generate--.

Column 6, Line 41, change “methodof” to --method of--.

Signed and Sealed this

Thirtieth Day of October, 2007

JON W. DUDAS
*Director of the United States Patent and Trademark Office*